US006579385B2

(12) United States Patent
Yaguchi et al.

(10) Patent No.: US 6,579,385 B2
(45) Date of Patent: Jun. 17, 2003

(54) FREE MACHINING STEEL FOR USE IN MACHINE STRUCTURE OF EXCELLENT MECHANICAL CHARACTERISTICS

(75) Inventors: Hiroshi Yaguchi, Kobe (JP); Yosuke Shindo, Kobe (JP); Takehiro Tsuchida, Kobe (JP); Takahiro Kudou, Kobe (JP); Masato Kaiso, Kobe (JP); Masami Somekawa, Kobe (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/931,093

(22) Filed: Aug. 17, 2001

(65) Prior Publication Data

US 2002/0044878 A1 Apr. 18, 2002

(30) Foreign Application Priority Data

Aug. 31, 2000 (JP) ..... 2000-263998

(51) Int. Cl.[7] ..... C22C 38/14

(52) U.S. Cl. ..... 148/328; 148/320; 148/547; 148/548

(58) Field of Search ..... 148/320, 328, 148/547, 548; 75/316

(56) References Cited

U.S. PATENT DOCUMENTS

| | | | |
|---|---|---|---|
| 4,004,922 A | | 1/1977 | Thivellier et al. |
| 4,806,304 A | * | 2/1989 | Kimura et al. |

FOREIGN PATENT DOCUMENTS

| | | | |
|---|---|---|---|
| JP | 59-205453 | | 11/1984 |
| JP | 62-23970 | | 1/1987 |
| JP | 5-271743 | | 10/1993 |
| JP | 5-311225 | | 11/1993 |
| JP | 7-188853 | | 7/1995 |
| JP | 7-238339 | | 9/1995 |
| JP | 7-238342 | | 9/1995 |
| JP | 08092687 | * | 4/1996 |
| JP | 8-225822 | | 9/1996 |
| JP | 8-291366 | | 11/1996 |
| JP | 9-157786 | | 6/1997 |
| JP | 10324947 | * | 12/1998 |
| JP | 11-323488 | | 11/1999 |
| JP | 2000-87179 | | 3/2000 |
| JP | 2000-282169 | | 10/2000 |

OTHER PUBLICATIONS

U.S. patent application Ser. No. 09/935,583, Shindo et al., filed Aug. 24, 2001.*

* cited by examiner

*Primary Examiner*—Sikyin Ip
(74) *Attorney, Agent, or Firm*—Oblon, Spivak, McClelland, Maier & Neustadt, P.C.

(57) ABSTRACT

Free machining steel for use in machine structures capable of stably and reliably providing excellent machinability (chip disposability and tool life) and mechanical characteristics (transverse direction toughness) comparable, in a Pb free state, with existent Pb-added steels the machining steel being manufactured so as to contain 0.0005 to 0.02 mass % of Mg and provide a distribution index F1 for the sulfide particles defined by the following equation (1) of 0.4 to 0.65 or a distribution index for the sulfide particles defined by the following equation (2) of 1 to 2.5:

$$F1=X_1/(A/n)^{1/2} \quad (1), \text{ or}$$

$$F2=\sigma F/X_2 \quad (2)$$

as described in the specification.

12 Claims, 4 Drawing Sheets

FREE MACHINING STEEL FOR USE IN MACHINE STRUCTURE OF EXCELLENT MECHANICAL CHARACTERISTICS

BACKGROUND OF THE INVENTION

1. Field of the Invention

This invention concerns a free machining steel for use in machine structures intended to be machined as components of industrial machines, automobiles and electric products and, more in particular, it intends to provide a free machining steel for use in machine structures having excellent machinability in a so-called Pb free steel, containing no substantial Pb as a machinability improving ingredient and also excellent mechanical characteristics.

2. Description of Related Art

Materials for components of industrial machines, automobiles and electric products are required to have good machinability since such components are manufactured by machining the materials. In view of the above, free machining steels for use in machine structures have usually been used as the materials and such free machining steels are often incorporated with Pb or S as a machinability improving ingredient and, particularly, it has been known that Pb provides excellent machinability with addition of a small amount.

As the technique described above, JP-A-205453/1984, for example, proposes a free machining steel for free machining low carbon sulfur steel in which all of Te, Pb and Bi are added in combination, MnS type inclusions each having a major diameter and a minor diameter of larger than a predetermined size and with a (major diameter/minor diameter) ratio of 5 or less are present by 50% or more of the entire MnS inclusions and the $Al_2O_3$ content in oxide inclusions is 15% or less.

Further, JP-A-23970/1987 proposes a technique of improving the machinability of a free machining low carbon sulfur-lead steel by a continuous casting method in which each of the contents for C, Mn, P, S, Pb, O, Si and Al is defined and the average size of MnS type inclusions and the ratio of sulfide type inclusions not bonded with oxides are defined thereby improving the machinability.

Each of the techniques described above concerns free machining steel with combined addition of Pb and S. As the problem of environmental pollution caused by Pb has been highlighted, use of Pb has tended to be restricted also in iron and steel materials and a study on the technique for improving the machinability in a so-called Pb free state has been progressed positively.

In view of the situation, a study for improving the machinability by controlling the form, for example, the size or the shape of sulfide type inclusions such as MnS has been predominant in the free machining sulfur steel, but no free machining steel that can provide machinability comparable with free machining Pb steel have yet been attained. Further, in the study of improving the machinability by controlling the form of the sulfide type inclusions, it has been pointed out also a problem that the sulfide inclusions such as MnS are deformed lengthwise along with plastic deformation of the base metal upon rolling or forging the steel material, which causes anisotropy in the mechanical characteristics and the impact resistance in a certain direction.

By the way, the machinability is evaluated by the items such as (1) cutting force, (2) tool life, (3) roughness on the finished surface and (4) chip disposability. Among the items, importance has been attached so far to the tool life and the roughness on the finished surface, but the chip disposability has also become an innegligible subject in view of operation efficiency and safety along with the recent automation or man-less trend in machining operation. That is, the chip disposability is a characteristic for evaluating disconnection of chips into shorter segments during machining. If the characteristic is worsened, chips extend spirally to bring about a trouble that they twine around the cutting tool to hinder the safety operation of machining. Existent Pb-added steels can provide a relatively good machinability also in view of the chip disposability but favorable characteristics have not yet been attained in the Pb-free steel materials.

SUMMARY OF THE INVENTION

This invention has been accomplished in view of the foregoing situations and intends to provide a free machining steel for use in machine structures that can stably and reliably provide, in a Pb-free state, excellent machinability (particularly, chip disposability and tool life) and mechanical characteristics (transverse direction toughness), which are comparable with those of existent Pb-added steels.

In accordance with this invention for attaining the foregoing object, there is provided a free machining steel for use in machine structures in which sulfide type inclusions are present wherein Mg is contained by from 0.0005 to 0.02 mass % and the distribution state for the sulfide type inclusions is controlled, to thereby improve mechanical characteristics. More specifically, there is provided a free machining steel for use in machine structures in which sulfide type inclusions are present, wherein Mg is contained by from 0.0005 to 0.02% ("%" means "mass %" here and hereinafter) and a distribution index F1 for the sulfide type inclusion particles defined by the following equation (1) is from 0.4 to 0.65:

$$F1=X_1/(A/n)^{1/2} \quad (1),$$

where $X_1$: represents an average value ($\mu$m) obtained by actually measuring the distance between each of sulfide type inclusion particle in an observed visual field and other particle nearest thereto for all of particles present in the observed visual fields, measuring the distance for five visual fields and averaging them, where A: represents an observed area ($mm^2$), and n: represents the number of sulfide type inclusions observed within the observed area (number).

Further, the foregoing object of this invention can be attained also by a free machining steel for use in machine structures in which Mg is contained by from 0.0005 to 0.02% and a distribution index F2 for the sulfide type inclusion particles defined by the following equation (2) is from 1 to 2.5:

$$F2=\sigma/X_2 \quad (2),$$

where $\sigma$: represents a standard deviation for the number of sulfide type inclusion particles per unit area, and $X_2$: represents an average value for the number of inclusion particles per unit area.

In each of the free machining steels for use in machine structures, it is preferred to satisfy the condition that the ratio of a major diameter L1 to a minor diameter L2 (L1/L2) of the sulfide type inclusions is from 1.5 to 5, which can further improve the mechanical characteristic (transverse direction toughness) and the machinability (particularly, chip disposability and tool life).

The chemical ingredients of the free machining steel for use in the machine structures according to this invention preferably contains, in addition to Mg, C in an amount from 0.01 to 0.7%, Si in an amount from 0.01 to 2.5%, Mn in an amount from 0.1 to 3%, S in an amount from 0.01 to 0.2%, P in an amount 0.05% or less (inclusive 0%), Al in an amount of 0.1% or less (inclusive 0%) and N in an amount from 0.002 to 0.02%, respectively, in view of ensuring physical properties required as the free machining steel for use in machine structures. It is also useful to optionally incorporate at least one member selected from the group consisting of (a) Ti in an amount from 0.002 to 0.2%, Ca in an amount from 0.0005 to 0.02%, and from 0.0002 to 0.2% in total of rare earth elements and (b) Bi in an amount of 0.3% or less (exclusive 0%).

In order to solve the subjects described above, the present inventors have studied the relation, particularly, the relation between the chip disposability and the sulfide inclusions in the free machining steel with various points of view. As a result, it has been found that not only the size and the shape of the sulfide type inclusions such as MnS but also the distribution state of the sulfide type inclusions has a close concern with the chip disposability. As a result of a further study, it has been found that a free machining steel for use in machine structures having, in the Pb-free state, excellent mechanical characteristics (transverse direction toughness) and chip disposability, and also excellent tool life can be provided by controlling the distribution state of the sulfide type inclusions and incorporating Mg in an amount from 0.0005 to 0.02%, and the present invention has been accomplished. The function and the effect of the invention are to be explained below.

The free machining steel for use in machine structures of excellent mechanical characteristics according to this invention has features in incorporating Mg in an amount from 0.0005 to 0.02%b and in controlling the distribution state of the sulfide type inclusions as described above.

Mg: 0.0005~0.2%

When Mg is added to a free machining steel, Mg-containing oxides form a nucleus for sulfide type inclusions to control the form of the inclusions and decrease large sulfide type inclusions thereby capable of obtaining a free machining steel for use in machine structures excellent both in the mechanical characteristics (transverse direction toughness) and the chip disposability. Further, when Mg is added, an oxide composition which is usually present as a hard alumina type oxide is transformed into an Mg-containing oxide to lower the hardness of the hard alumina type oxide. The disadvantage which may be caused by the hard Mg-containing oxide can be mitigated by the effect that the Mg-containing oxide is surrounded with the sulfide leading to the improvement for the tool life. However, if the Mg content is less than 0.0005%, the solid solubilized amount of Mg in the sulfide is not sufficient and the form of the sulfide type inclusions can not be controlled effectively. Further, if it exceeds 0.02%, the sulfides are excessively hard to lower the machinability (chip disposability).

As has been described above, disconnection of the chips into fine segments is required, as one of the evaluation items for the machinability in the automated machining. The present inventors have confirmed that disconnection of the chips is caused by the occurrence of cracks due to stress concentration to the vicinity of the inclusions present in the steel. Further, when inclusions are present being extended lengthwise in the steel a favorable chip disposability can be obtained in the machining along a certain direction but the chip disposability is lowered abruptly when the machining direction changes. On the other hand, in the case of spherical inclusions, although there is no anisotropy that the machinability changes depending on the machining direction, the chip disposability is not always satisfactory.

When the present inventors have made various studies on the means for evaluating the distribution state of the sulfide type inclusion particles based on the analysis during machining as described above, it has been found that the foregoing object can be attained effectively when Mg is incorporated by 0.0005 to 0.02% and the distribution index F1 or F2 for the sulfide type inclusion particles defined by equation (1) or (2) above is within a predetermined range. Then, the distribution indexes F1, F2 of the sulfide type inclusion particles are to be explained.

At first, the distribution index F1 for the sulfide type inclusion particles means the value for the ratio: $[(X_1/(A/n)^{1/2}]$, in which $X_1$ represents an average value obtained by actually measuring a distance between each of sulfide type inclusion particles and other particle nearest thereto in an observed visual field, for all of the particles present in the observed visual field, measuring the distance with respect to five visual fields and averaging them, and $(A/n)^{1/2}$ means an inter particle distance when all of the observed particles are arranged uniformly on lattice points (where A represents an observed area ($mm^2$) and n represents the number of sulfide type inclusion particles observed within the observed area (N).

As an example, explanation is to be made to a case where the twelve sulfide type inclusion particles are present in the observed visual field with reference to FIG. 1. In the actual observation visual field, sulfide type inclusion particles are distributed as shown in FIG. 1A and, assuming the nearest distance on each of the sulfide type inclusions as $x_1$–$x_{12}$, the average value $X_1$ is represented as:

$$X_1=(x_1+x_2+\ldots x_{12})/12$$

Assuming that the sulfide type inclusion particles are distributed uniformly as shown in FIG. 1B, the nearest distance on each of the sulfide type inclusion particles is represented as:

$$x_1=x_2\ldots=x_{12}$$

Assuming the observed area as A, the nearest distance $X_2$ can be represented as:

$$X_2=(x_1+x_2+\ldots x_{12})/12=(A/12)^{1/2}$$

The $X_1$ to $X_2$ ratio is defined as the distribution index F1 for the sulfide type inclusion particles.

The distribution index F1 for the sulfide type inclusion particles defined as described above takes a value approximate to 1 when the sulfide distribution is completely uniform but deviates from 1 and takes a value less than 1 when the distribution is not uniform. Then, according to the study of the present inventors, in the free machining steel according to this invention containing from 0.0005 to 0.02% of Mg, the form and the balance of the distribution state of the sulfide type inclusion particles are improved and both the chip disposability and the transverse direction toughness are favorable when the value F1 is within a range from 0.4 to 0.65. On the other hand, if the value exceeds 0.65, although the sulfide type inclusion particles are present uniformly, the chip disposability can not be said favorable. Further, if the value F1 is less than 0.4, the sulfide type inclusion particles are agglomerated and extended lengthwise during rolling or forging, failing to obtain a free machining steel excellent in both of the characteristics of the chip disposability and the transverse direction toughness.

On the other hand, the distribution index F2 for the sulfide type inclusion particles means a value obtained by dividing a visual field of a certain area into lattice, and normalizing the standard deviation σ for the number of sulfide type inclusions present in each of unit lattices by an average value $X_2$ for the number of sulfide type inclusion particles per unit area. In this case, when the sulfide type inclusions are distributed completely uniformly, the value F2 approaches 0. Then, in the free machining steel according to this invention containing Mg from 0.0005 to 0.02% of Mg, it has been found that when the value F2 is within a range from 1 to 2.5, the form and the distribution state of the sulfide type inclusion particles are favorable and both of the chip disposability and the lateral direction toughness are satisfactory. On the other hand, if it is less than 1, the sulfide type inclusion particles are distributed uniformly to deteriorate the chip disposability. Further, when the value F2 exceeds 2.5, the sulfide type inclusion particles are agglomerated and extended lengthwise by rolling or forging failing to obtain satisfactory transverse direction toughness.

Further, in the free machining steel for use in machine structures according to this invention, the ratio of the major diameter L1 to the minor diameter L2 (L1/L2 aspect ratio) for the sulfide type inclusions is preferably controlled to 1.5–5, which can provide further excellent chip disposability and transverse direction toughness. That is, the sulfide type inclusions are deformed to some extent by rolling or forging. When the aspect ratio for the sulfide type inclusions is less than 1.5 in average upon cutting the specimen in parallel and observed, the chip disposability is deteriorated. On the other hand, if the value is too large and exceeds 5, the transverse direction toughness is lowered.

There is no particular restriction on the kind of the steel material but with a view point of satisfying the characteristics required as the free machining steel for use in mechanical structure, it is preferred to incorporate, in addition to Mg, C in an amount from 0.01 to 0.7%, Si in an amount from 0.01 to 2.5%, Mn in an amount from 0.1 to 3%, S in an amount from 0.01 to 0.2%, P in an amount of 0.05% or less (inclusive 0%), Al in an amount of 0.1% or less (inclusive 0%) and N in an amount from 0.002 to 0.02%, respectively. When the compositional chemical ingredients are controlled as described above, good characteristics can be obtained while retaining required tensile strength as the free machining steel for use in machine structures as-the free machining steel for use in mechanical structure, and the distribution and the shape of the sulfide type inclusions are also improved to make both the machinability and the mechanical characteristics more excellent. The function for each of the ingredients described above is as shown below.

C: 0.01~0.7%

C is a most important element for ensuring the strength of a final product and the C content is preferably 0.01% or more, with a view point described above. However, if the C content becomes excessive, since the toughness is deteriorated and it gives undesired effect also on the machinability such as the tool life, it is preferably 0.7% or less. Further, a more preferred lower limit for the C content is 0.05% and, more preferable, upper limit is 0.5%.

Si: 0.01~2.5%

Si is effective as a deoxidation element and in addition also contributes to the improvement of strength of mechanical structural components by solid solution strengthening. In order to attain such an effect, it is contained, preferably, by 0.01% and, more preferably, by 0.1% or more. However, since excessive content gives an undesired effect on the machinability it is, preferably, 2.5% or less and, more preferably, 2% or less.

Mn: 0.1~3%

Mn is an element not only contributing to the improvement hardenability of a steel material to increase the strength but also contributing to the formation of sulfide type inclusions to contribute to the improvement of the chip disposability. For effectively attaining the effect, it is incorporated, preferably, by 0.1% or more. However, since excessive content rather deteriorates the machinability it is, preferably, 3% or less and, more preferably, 2% or less.

S: 0.01–0.2%

S is an element effective to the formation of sulfide type inclusions for improving the machinability. For attaining the effect, it is contained by, preferably, 0.01% or more and, more preferably, 0.03% or more. However, since excess S content tends to cause cracks starting from sulfides such as MnS it is, preferably, 0.2% or less and, more preferably, 0.12% or less.

P: 0.05% or less (inclusive 0%)

Since P tends to cause grain boundary segregation to deteriorate the impact strength, it should be kept to 0.05% or less and, more preferably, 0.02% or less.

Al: 0.1% or less (inclusive 0%)

Al is important as a deoxidation element upon making steel material by melting and, in addition, effective for forming nitrides for the refinement of the austenitic crystal grains. However, since excess content rather makes the crystal grain coarser to give an undesired effect on the toughness it is kept, preferably, to 0.1% or less and, more preferably, to 0.05% or less.

N: 0.002~0.02%

N forms, together with Al or Ti, fine nitrides to contribute to the improvement for refinement and increase in the strength of the texture. In order to attain the effect, it is incorporated by 0.002% or more. However, since excess content may possibly cause large nitrides it should be kept to 0.02% or less.

Preferred compositional chemical ingredients in the free machining steel for use in machine structures according to this invention are as has been described above, and the balance basically comprises iron and inevitable impurities. Since this invention has a technical feature in defining the distribution state of the sulfide type inclusions in the free machining steel containing Mg in an amount from 0.0005 to 0.02% as described above, other compositional chemical ingredients than Mg do not restrict the invention but the composition may be deviated somewhat from the preferred chemical ingredient composition described above depending on the application uses and the required characteristics for the free machining steel for use in machine structures. Further, in addition to the, the following elements may optionally be incorporated effectively.

One or More of Elements Selected from the Group Consisting of: Ti: 0.002~0.2%. Ca: 0.0005~0.02% and Rare Earth Element: 0.0002~0.2% in Total When the steel material is made by melting, the distribution state of the sulfide type inclusion particles changes by the addition of Ti, Ca, or rare earth element and more excellent characteristics can be obtained compared with the case of not adding them. However, if the Ti content is less than 0.002%, the addition effect is insufficient. On the other hand, if it is contained excessively beyond 0.2%, the impact resistance is remarkably deteriorated. Further, in a case of Ca, the addition effect is insufficient if the content is less than 0.0005%, whereas excessive addition amount of 0.02% or more causes lowering of the impact resistance like that for Ti. Further, in a case of rare earth element such as Ce, La, Pr or Nd, the additive effect thereof is not sufficient if the content is less than 0.002% in total, whereas the impact resistance is lowered like that for Ti or Ca if the content exceeds 0.2%. The elements such as Ti, Ca or rare earth element may be added either alone or two or more kinds of them may be added simultaneously. Since the transverse direction toughness is deteriorated if the total content exceeds 0.22%, the upper limit is defined as 0.22%.

Bi: 0.3% or less (exclusive 0%)

Bi is an element effective to the improvement of the machinability but excess content not only saturates the effect thereof but also deteriorates the hot forgeability to lower the mechanical characteristics, so that it should be 0.3% or less.

Further, in addition to Ti, Ca and the rare earth elements described above, Ni, Cr, Mo, Cu, V, Nb, Zr or B may also be incorporated to obtain a free machining steel for use in machine structures capable of satisfying the conditions of this invention.

When the melting method is used as a method of manufacturing the free machining steel for use in machine structures according to this invention, it is important to select the kind of Mg alloys used for the addition of Mg, and control the dissolved amount of oxygen upon adding the Mg alloy, the time from the addition of the Mg alloy to the start of casting, and the mean solidification rate (cooling rate) after the start of the casting to solidification in a well balanced manner. By controlling them in a good balance, it is possible to incorporate Mg by 0.0005–0.02% and control the distribution indexes F1, F2 for the sulfide inclusion particles defined by the formula (1) or (2) within the range of the invention. Particularly, the dissolved amount of oxygen upon addition of the Mg alloy is important for providing the effect of the Mg and the dissolved amount of oxygen is adjusted by optionally controlling the Al addition amount before addition of the Mg alloy in the examples to be described later. Further, there is no particular restriction on the kind of the sulfide type inclusions as an object of the invention and they may be sulfides of Mn, Ca, Zr, Ti, Mg and other elements, composite sulfides thereof, carbon sulfides or acid sulfides, so long as the distribution state of the inclusions can satisfy the conditions as defined in equation (1) or (2).

DETAILED DESCRIPTION OF THE PREFERRED EMBODIMENTS

Figure 1A:
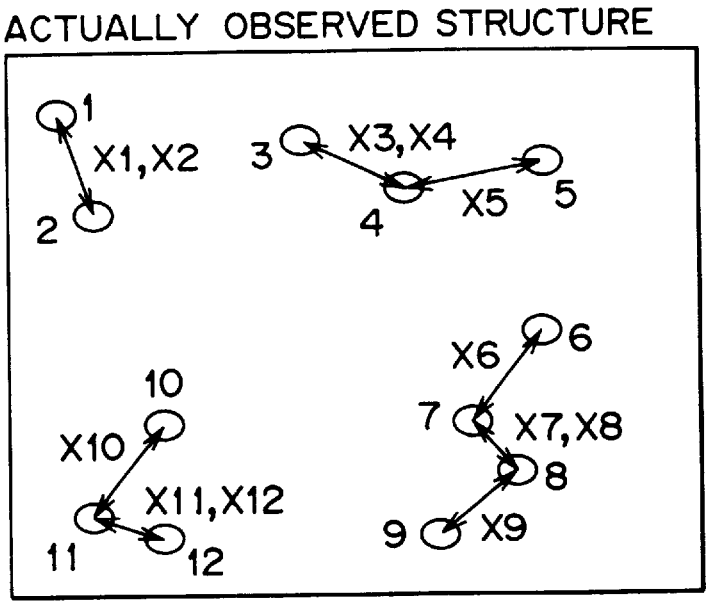
FIG. 1A is a view for specifically explaining the method of calculating a distribution index F1 for sulfide inclusion particles.

This invention is to be described more specifically, by way of examples but the following examples do not restrict the invention, and any design modification in accordance with the purpose described above and to be described later are contained within the technical scope of this invention.

EXAMPLE

Various kinds of steel materials were made by melting as below for comparative study of the distribution state for the sulfide type inclusion particles while varying them in the free machining steels.

By using high frequency induction furnace, C was at first added in a molten steel and, successively and Fe—Mn alloy, Fe—Si alloy were added and, further, Fe—Cr alloy and Fe—S alloy were added. Subsequently, Al and Mg were added. For the addition of Mg, one of lumpy Ni—Mg alloy, Si—Mg alloy and Ni—Mg—Ca alloy was used. The dissolved oxygen in the molten steel upon addition of the Mg alloy was adjusted by controlling the Al addition amount before addition of the Mg alloy. Further, ingots of 140 mmϕ were cast while varying the time from the addition of the Mg alloy to the casting and the mean coagulation rate after the casting. Table 1 shows the chemical ingredient compositions for each sample, and Table 2 shows the dissolved oxygen amount, the species of the added alloys, the time up to casting and the mean solidification rate.

TABLE 1

| | Chemical ingredient composition (mass %) | | | | | | | | | | | |
|---|---|---|---|---|---|---|---|---|---|---|---|---|
| No. | C | Si | Mn | P | S | Cr | Al | N | Mg | Bi | O | Others |
| 1 | 0.30 | 0.013 | 0.85 | 0.01 | 0.060 | 0.13 | 0.020 | 0.006 | 0.0023 | — | 0.0011 | |
| 2 | 0.29 | 0.014 | 0.85 | 0.01 | 0.060 | 0.13 | 0.022 | 0.005 | 0.0022 | — | 0.0008 | |
| 3 | 0.31 | 0.014 | 0.86 | 0.01 | 0.056 | 0.13 | 0.021 | 0.006 | 0.0025 | — | 0.0022 | |
| 4 | 0.30 | 0.014 | 0.87 | 0.01 | 0.058 | 0.13 | 0.022 | 0.006 | 0.0004 | — | 0.0011 | |
| 5 | 0.30 | 0.013 | 0.88 | 0.02 | 0.059 | 0.13 | 0.023 | 0.006 | 0.0023 | — | 0.0010 | |
| 6 | 0.29 | 0.012 | 0.86 | 0.02 | 0.095 | 0.12 | 0.025 | 0.005 | 0.0026 | — | 0.0013 | |
| 7 | 0.31 | 0.015 | 0.84 | 0.01 | 0.095 | 0.13 | 0.028 | 0.005 | 0.0058 | — | 0.0014 | |
| 8 | 0.30 | 0.014 | 0.85 | 0.01 | 0.096 | 0.13 | 0.024 | 0.006 | 0.0004 | — | 0.0018 | |
| 9 | 0.45 | 0.022 | 1.01 | 0.02 | 0.055 | 0.12 | 0.025 | 0.005 | 0.0025 | — | 0.0012 | |
| 10 | 0.30 | 0.012 | 0.84 | 0.02 | 0.057 | 0.12 | 0.025 | 0.005 | 0.0032 | — | 0.0013 | Ca: 0.0017 |

TABLE 1-continued

| No. | Chemical ingredient composition (mass %) | | | | | | | | | | | |
|---|---|---|---|---|---|---|---|---|---|---|---|---|
| | C | Si | Mn | P | S | Cr | Al | N | Mg | Bi | O | Others |
| 11 | 0.31 | 0.017 | 0.85 | 0.02 | 0.06 | 0.13 | 0.022 | 0.004 | 0.0025 | — | 0.0014 | Ti: 0.015 |
| 12 | 0.29 | 0.018 | 0.86 | 0.02 | 0.055 | 0.14 | 0.024 | 0.006 | 0.0026 | — | 0.0015 | REM: 0.008 |
| 13 | 0.30 | 0.014 | 0.86 | 0.02 | 0.056 | 0.13 | 0.028 | 0.006 | 0.0022 | 0.02 | 0.0017 | |
| 14 | 0.30 | 0.0008 | 0.79 | 0.02 | 0.055 | 0.12 | 0.001 | 0.005 | — | — | 0.0042 | |

REM sum = % Ce + % La + % Pr + % Nd

TABLE 2

| No. | Dissolved oxygen amount (ppm) | Species of added alloy | Time up to casting (min) | Mean solidification rate (° C./min) |
|---|---|---|---|---|
| 1 | 8.0 | Ni—Mg | 6.5 | 32 |
| 2 | 4.9 | Ni—Mg | 6.5 | 32 |
| 3 | 18.2 | Ni—Mg | 7 | 32 |
| 4 | 8.2 | Si—Mg | 7 | 32 |
| 5 | 8.0 | Ni—Mg | 6.5 | 10 |
| 6 | 7.9 | Ni—Mg | 7.5 | 32 |
| 7 | 7.8 | Ni—Mg | 7 | 32 |
| 8 | 8.5 | Ni—Mg | 15 | 32 |
| 9 | 8.5 | Ni—Mg | 7 | 32 |
| 10 | 9.1 | Ni—Mg—Ca | 6.5 | 32 |
| 11 | 7.7 | Ni—Mg | 6.5 | 32 |
| 12 | 10.2 | Ni—Mg | 6 | 32 |
| 13 | 7.9 | Ni—Mg | 7.5 | 32 |
| 14 | — | — | — | 32 |

Cast ingots obtained by the casting described above were heated to about 1200° C., hot forged to 80 mmϕ, cut into an appropriate size and subjected to quenching, tempering to adjust the Vickers hardness uniformly as 270±10. Then, a machining test, measurement for the tool life and impact test were conducted, and the form of sulfide type inclusion particles was measured.

For the machining test, a test piece cut out in a direction perpendicular to the direction malleably extended by forging such that the specimen is machined in a direction parallel with the extended direction by forging. A straight drill made of high speed steel (diameter: 10 mm) was used and the number of chips for two bores was counted. Further, dry machining was conducted under the machining conditions at a speed of 20 m/min, feed rate of 0.2 mm/rev and a hole depth of 10 mm. In the measurement of the tool life, identical conditions with those in the machining test were used except for increasing the speed to 50 m/min.

Further, a test piece cut out orthogonal to the direction malleably by forging was used and a Charpy impact test was conducted to determine the transverse direction toughness.

On the other hand, for measuring the form of sulfides, a test piece cut out parallel with the direction extended by forging was used. Measurement was conducted on every 100 visual fields with area of 0.5 mm×0.5 mm per visual field by using an optical microscope at a magnification ratio by the factor of 100 and the shape and the distribution state of the sulfide type intrusions were image-analyzed as shown below.

(Shape of Sulfide Type Inclusions)

Figure 2A:
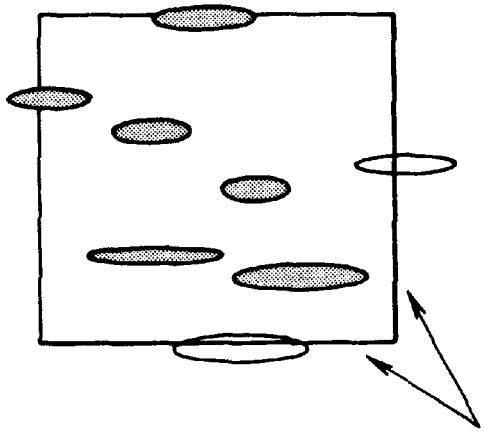
FIG. 2A is a view for explaining the method of counting the number of sulfide type inclusions present in the observed visual field.
Figure 2B:
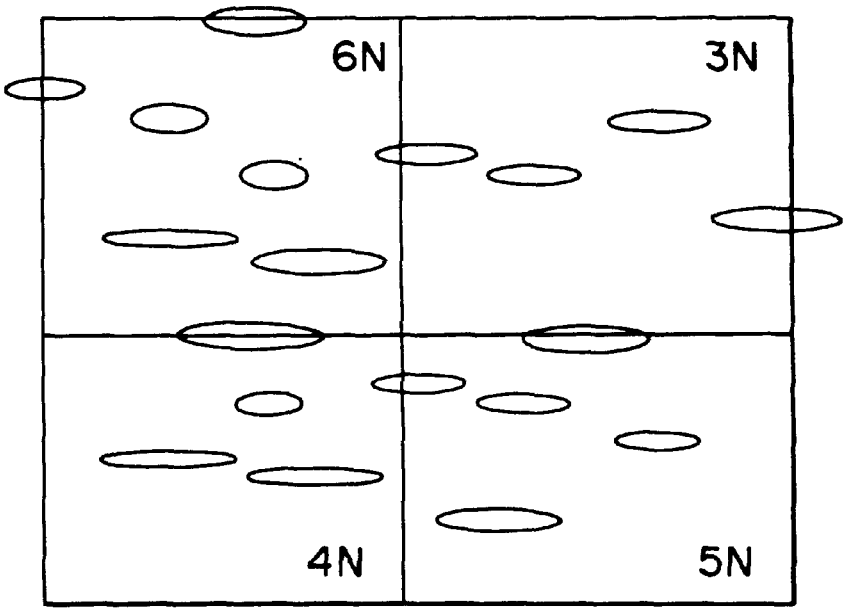
FIG. 2B is a view for explaining the method of counting the number of sulfide type inclusions present in the observed visual field.

For the shape of the sulfide type inclusion particles, the major diameter, the minor diameter, the area and the number were measured for sulfide type inclusions each of an area of 1.0 $\mu m^2$ or more for all of the observed 100 visual fields. In a case where the inclusion particles were present extending over the two observation visual fields, inclusion particles overriding two sides among four sides of the visual fields in contact with adjacent images were not counted so as not to count the number of particles being overlapped. That is, as shown in FIG. 2A, inclusion particles in contact with the right side and the bottom side were not counted but they were counted as the inclusions in the next observation visual field. Specifically, as shown in FIG. 2B, the number of sulfide type inclusion particles was counted in the visual field.

(Distribution State of Sulfide Type Inclusions)

The distribution state of the sulfide type inclusion particles was evaluated by the distribution index F1 or F2 for the sulfide type inclusion particles as shown below.

[F1]

For each visual field with an area of 0.5 mm×0.5 mm, the gravitational center for the sulfide type inclusion particle with an area of 1.0 $\mu m^2$ or more was determined, the distance between the gravitational centers was measured for each of the sulfide inclusion particles relative to other sulfide type inclusion particle, and the distance to the particle present nearest was determined for each particle. Then, the ratio of the average value $X_1$ for the actually measured value of the distance between nearest particles in each of the visual fields to the distance between the nearest particle in which an identical number of sulfide type inclusion particles were uniformly dispersed within an identical area in a lattice pattern $[(A/n)^{1/2}]$, that is, the ratio $[X_1/(A/n)^{1/2}]$ was taken and defined as the distribution index F1 for the sulfide type inclusion particle. The index was measured for five visual fields and an average value was determined. The area for the targeted sulfide was defined as 1.0 $\mu m^{1/2}$ or more, because no substantial effect was obtained by controlling the sulfides of smaller size.

[F2]

Each visual field with an area of 0.5 mm×0.5 mm was divided into 25 lattices each of 0.1 mm×0.1 mm (uniformly divided by five in each of longitudinal and lateral directions), the number of particles whose gravitational centers are contained in each lattice was measured, the deviation for the number was calculated between each of 25 lattices as the standard deviation σ and the value obtained by normalizing the standard deviation σ by an average value $X_2$ for the number (average value for the number of sulfide particles per unit area) $(\sigma/X_2)$ was defined as the distribution index F2 for the sulfide type inclusion particles. The index was measured for five visual fields and an average value was determined. Table 3 shows the distribution index and the form (aspect ratio) of the sulfide type inclusion particles and the results of the machining test, tool life measurement and impact test.

TABLE 3

| No. | Sulfide particle distribution index F1 | F2 | Aspect ratio | Number of chips (N/g) | Tool life (cm) | Transverse direction toughness ($J/cm^2$) | Remarks |
|---|---|---|---|---|---|---|---|
| 1 | 0.55 | 1.23 | 2.5 | 26 | 45 | 26.5 | Working example |
| 2 | 0.39 | 2.71 | 3.8 | 36 | 28 | 17.7 | Comparative examples |
| 3 | 0.38 | 2.65 | 3.7 | 33 | 28 | 18.6 | |
| 4 | 0.35 | 2.74 | 3.9 | 36 | 29 | 16.7 | |
| 5 | 0.38 | 2.58 | 4.0 | 35 | 28 | 16.7 | |
| 6 | 0.48 | 1.57 | 2.8 | 32 | 56 | 24.5 | Working examples |
| 7 | 0.54 | 1.26 | 2.6 | 30 | 62 | 25.5 | |
| 8 | 0.37 | 2.65 | 3.5 | 35 | 29 | 17.7 | Comparative example |
| 9 | 0.54 | 1.25 | 2.6 | 28 | 34 | 21.6 | Working examples |
| 10 | 0.62 | 1.19 | 2.2 | 25 | 72 | 28.4 | |
| 11 | 0.43 | 2.03 | 3.2 | 33 | 40 | 24.5 | |
| 12 | 0.45 | 1.89 | 2.9 | 34 | 39 | 24.5 | |
| 13 | 0.54 | 1.24 | 2.6 | 42 | 113 | 26.5 | |
| 14 | 0.67 | 0.95 | 1.4 | 16 | 22 | 27.5 | Comparative example |

Figure 3A:
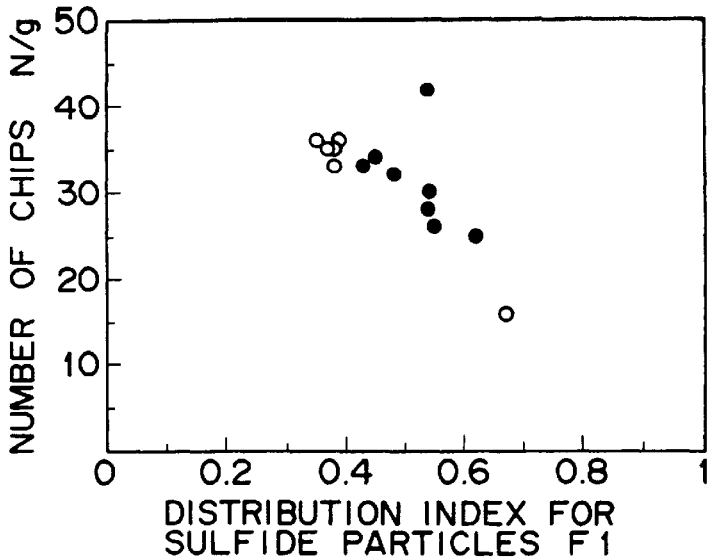
FIG. 3A is a graph formed by plotting number of chips against the value F1.
Figure 3B:
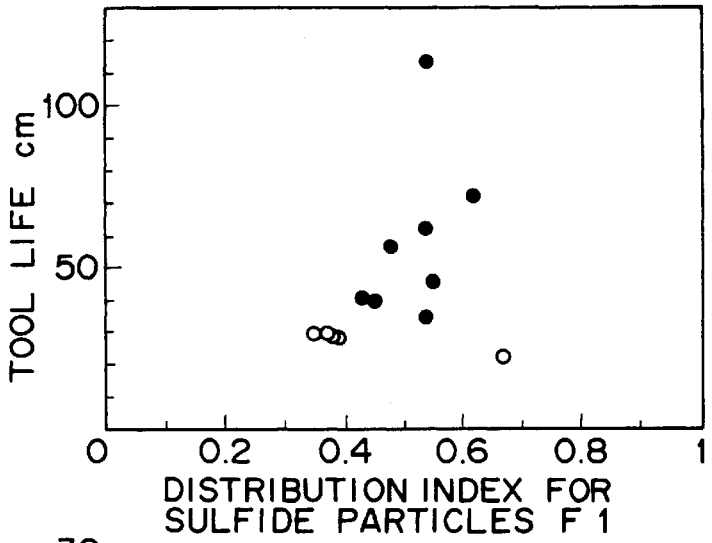
FIG. 3B is a graph formed by plotting tool life against the value F1.
Figure 3C:
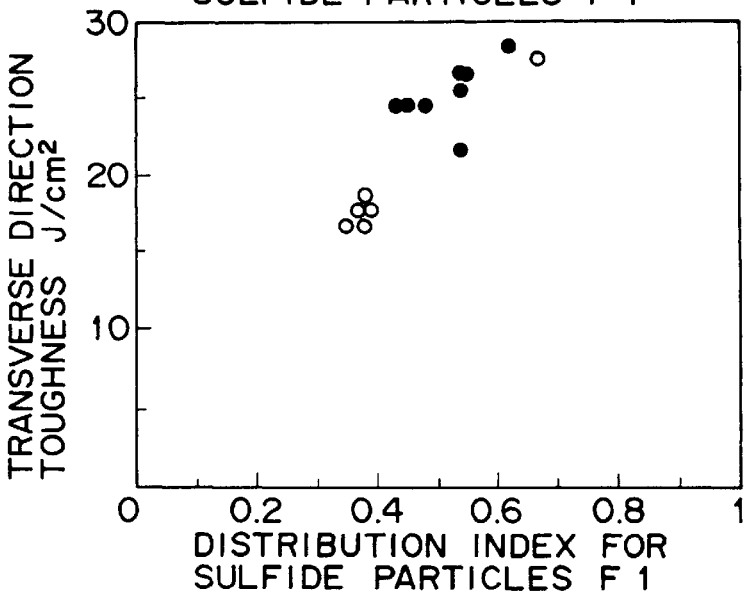
FIG. 3C is a graph formed by plotting transverse direction toughness against the value F1.
Figure 4A:
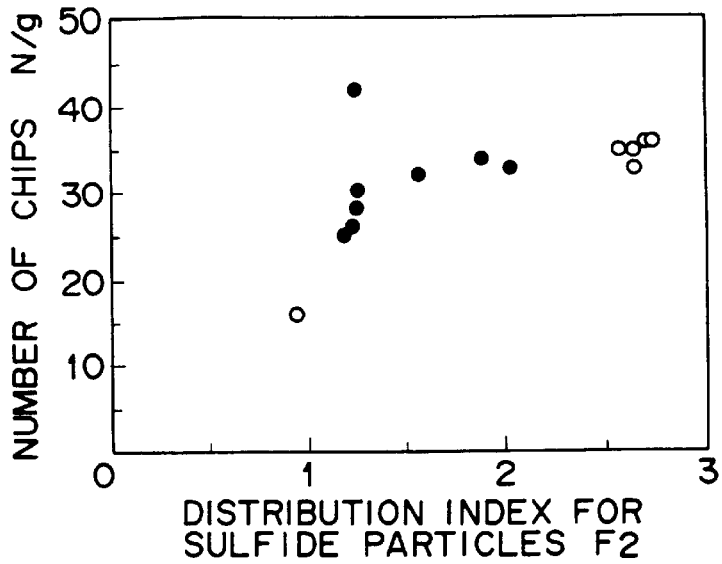
FIG. 4A is a graph formed by plotting number of chips against the value F2.
Figure 4B:
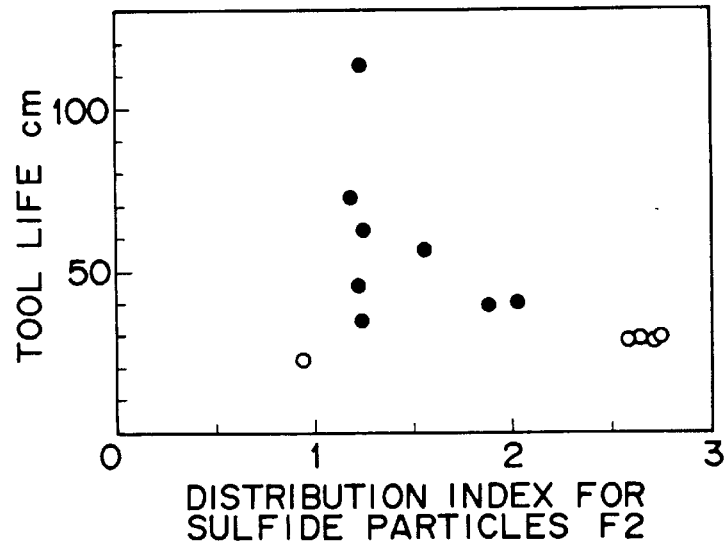
FIG. 4B is a graph formed by plotting tool life against the value F2.
Figure 4C:
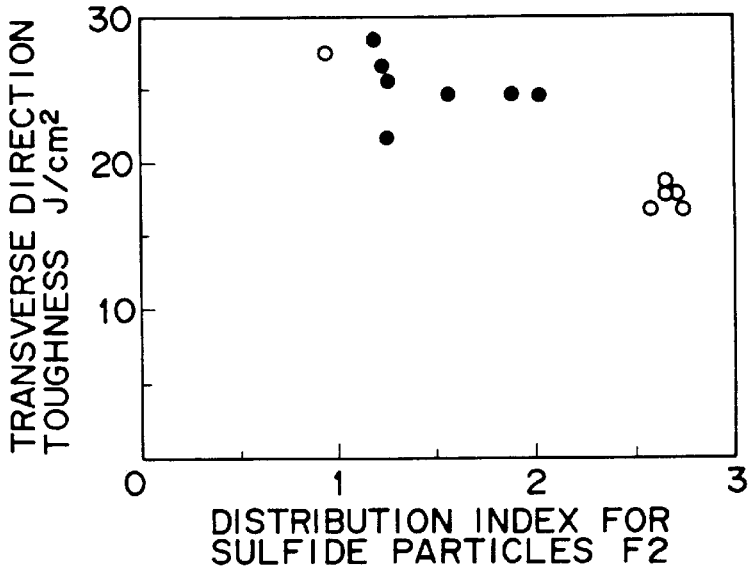
FIG. 4C is a graph formed by plotting transverse direction toughness against the value F2.

In FIG. 3, (3A) number of chips, (3B) tool life and (3C) transverse direction toughness are plotted against the distribution index F1 for the sulfide type inclusion particles and, in FIG. 4, (4A) number of chips, (4B) tool life and (4C) transverse direction toughness were plotted against F2. Examples of the invention satisfying F1 or F2 were indicated by "●" and comparative examples were indicated by "○".

Figure 1B:
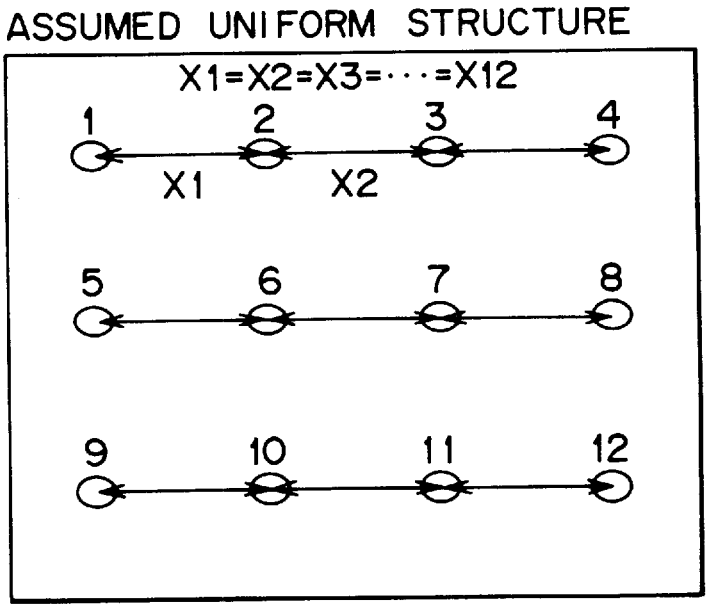
FIG. 1B is a view for specifically explaining the method of calculating a distribution index F1 for sulfide inclusion particles.

From the results, it can be considered as below. Nos. 1, 6, 7 and 9 to 13 are examples of the invention which are free machining steels with well balanced manufacturing conditions and capable of satisfying all of F1, F2 and aspect ratio, as well as both of the chip disposability and the mechanical characteristics (transverse direction toughness) were favorable. As can be seen from FIG. 1B or FIG. 2B, the example of the invention are free machining steels for use in machine structures particularly excellent in tool life.

On the other hand, Nos. 2 to 5 and 8 are comparative examples in which manufacturing conditions for the free machining steel were not balanced and although they could satisfy the aspect ratio none of them satisfied both F1 and F2. That is, they were free machining steels having good chip disposability but not excellent in the mechanical characteristics (transverse direction toughness) and in the tool life. Particularly, in No. 8, the content for Mg is also out of the condition of this invention.

Further, also No. 14 is a comparative example which contained no Mg at all. No. 14 did not satisfy the conditions of the invention regarding all of F1, F2 and the aspect ratio and it showed a result that although the mechanical characteristics (transverse direction toughness) was substantially equal with the examples of the invention the chip disposability and the tool life were extremely poor.

This invention has been constituted as described above, which can provide a free machining steel containing Mg and having mechanical characteristics (transverse direction toughness) and chip disposability comparable, even in a Pb-free state, with those of existent Pb-added steel and, further, capable of stably and reliably providing excellent tool life.

What is claimed is:

1. A free machining steel for use in machine structures in which sulfide inclusions are present, wherein Mg is contained by from 0.0005 to 0.02 mass % and a distribution index F1 for the sulfide inclusion particles defined by the following equation (1) is from 0.4 to 0.65:

$$F1=X_1/(A/n)^{1/2} \quad (1),$$

where $X_1$: represents an average value ($\mu$m) obtained by actually measuring the distance between each sulfide inclusion particle in an observed visual field and another particle nearest thereto for all of particles present in the observed visual fields, measuring the distance for five visual fields and averaging them, where A: represents an observed area ($mm^2$), and n: represents the number of sulfide inclusions observed within the observed area.

2. A free machining steel for use in mechanical structure as defined in claim 1, wherein the ratio of a major diameter L1 to a minor diameter L2 (L1/L2) for the sulfide inclusion is from 1.5 to 5.

3. A free machining steel for use in machine structures as defined in claim 1, containing, on the mass % basis,

C: 0.01~0.7%,

Si: 0.01~2.5%,

Mn: 0.1~3%,

S: 0.01~0.2%,

P: 0.05% or less (inclusive 0%),

Al: 0.1% or less (inclusive 0%),

N: 0.002~0.02%, respectively.

4. A free machining steel for use in machine structures as defined in claim 3 further containing, on the mass % basis, at least one of elements selected from the group consisting of:

Ti: 0.002~0.2%,

Ca: 0.0005~0.02%, and rare earth element: 0.0002~0.2% in total.

5. A free machining steel for use in machine structures as defined in claim 3 further containing, on the mass % basis, Bi: 0.3% or less (inclusive 0%).

6. A method of making a free machining steel, the method comprising casting a molten steel; and producing the steel of claim 1.

7. A free machining steel for use in machine structures in which sulfide inclusions are present, wherein Mg is contained by from 0.0005 to 0.02% and a distribution index F2 for the sulfide inclusion particles defined by the following equation (2) is from 1 to 2.5:

$$F2=\sigma/X_2 \quad (2),$$

where

σ: represents a standard deviation for the number of sulfide inclusion particles per unit area, and $X_2$: represents an average value for the number of inclusion particles per unit area.

8. A free machining steel for use in mechanical structure as defined in claim 7, wherein the ratio of a major diameter L1 to a minor diameter L2 (L1/L2) for the sulfide inclusion is from 1.5 to 5.

9. A free machining steel for use in machine structures as defined in claim 7 containing, on the mass % basis,

C: 0.01~0.7%,

Si: 0.01~2.5%,

Mn: 0.1~3%,

S: 0.01~0.2%,

P: 0.05% or less (inclusive 0%),

Al: 0.1% or less (inclusive 0%),

N: 0.002~0.02%, respectively.

10. A free machining steel for use in machine structures as defined in claim 9 further containing, on the mass % basis, at least one of elements selected from the group consisting of:

Ti: 0.002~0.2%,

Ca: 0.0005~0.02%, and rare earth element: 0.0002~0.2% in total.

11. A free machining steel for use in machine structures as defined in claim 9 further containing, on the mass % basis, Bi: 0.3% or less (inclusive 0%).

12. A method of making a free machining steel, the method comprising casting a molten steel; and producing the steel of claim 7.

* * * * *